US006598294B2

(12) United States Patent
Yamaguchi et al.

(10) Patent No.: US 6,598,294 B2
(45) Date of Patent: Jul. 29, 2003

(54) METHOD OF FABRICATING A CATALYST CONVERTER

(75) Inventors: Fumihisa Yamaguchi, Tokyo (JP); Yasuhiro Nogami, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/090,765

(22) Filed: Mar. 6, 2002

(65) Prior Publication Data

US 2002/0133947 A1 Sep. 26, 2002

(30) Foreign Application Priority Data

Mar. 21, 2001 (JP) ..... 2001-080973

(51) Int. Cl.[7] ..... B23P 15/00
(52) U.S. Cl. ..... 29/890; 29/557; 219/61
(58) Field of Search ..... 29/890, 557; 228/135, 228/151, 144, 173.4, 173.6; 219/653, 59.1, 61, 121.44, 121.64

(56) References Cited

U.S. PATENT DOCUMENTS 5,701,737 A * 12/1997 Branik et al. ..... 60/299
5,797,183 A * 8/1998 Humpolik et al. ..... 29/890
5,909,916 A * 6/1999 Foster et al. ..... 29/890
6,001,314 A * 12/1999 Buck et al. ..... 422/177
2002/0062562 A1 * 5/2002 Li et al. ..... 29/890
2002/0168303 A1 * 11/2002 Nogami ..... 422/177

FOREIGN PATENT DOCUMENTS

JP 2000-256809 * 9/2000

* cited by examiner

*Primary Examiner*—I Cuda Rosenbaum
(74) *Attorney, Agent, or Firm*—Foley & Lardner

(57) ABSTRACT

A method of fabricating a catalyst converter includes the steps of: obtaining a tubular member by rolling up a metallic plate member of a rectangular shape having ear portions at four corners thereof such that opposing ones of the ear portions abut against each other, and by effecting butt welding for both ends of the plate member; cutting off projecting portions formed by the ear portions at both ends of a weld of the tubular member; incorporating a catalyst carrier into the tubular member with the projecting portions cut off; effecting drawing for both end portions of the tubular member with the catalyst carrier incorporated therein; and attaching a pair of flanges, respectively, to the both end portions of the tubular member subjected to drawing.

3 Claims, 3 Drawing Sheets

METHOD OF FABRICATING A CATALYST CONVERTER

BACKGROUND OF THE INVENTION

1. Field of the Invention

The present invention relates to a method of fabricating a catalyst converter for purifying exhaust gases.

2. Description of the Related Art

As for this type of catalyst converter, it is conventionally known that diffuser portions of a cylinder portion of the catalyst converter are formed by plastic processing based on spinning.

FIG. 3 shows one example of the above catalyst converter.

First, a metallic plate member 1 of a rectangular shape is prepared. Next, this plate member 1 is rolled up, and its both ends la are caused to abut against each other and are subjected to welding such as tungsten inert gas welding (TIG) or metal inert gas arc welding (MIG).

Next, a catalyst carrier 3 is pres fitted into a tubular member 2 thus formed.

Next, drawing based on spinning is effected for both end portions 2*a* and 2*b* of the tubular member 2 with the catalyst carrier 3 incorporated therein.

Next, a pair of flanges 4 are attached to opposite ends of the both end portions 2*a* and 2*b* of the tubular member 2 subjected to drawing.

A catalyst converter 5 can be obtained in the above-described manner.

According to the conventional fabrication method, however, when after the plate member 1 is rolled up, both ends 1*a* are caused to abut against each other and are subjected to welding such as TIG or MIG, as shown in FIG. 4, burn through occurs at a starting point and a terminating point of welding of the plate member 1, and if drawing based on spinning is effected for the both end portions 2*a* and 2*b* of the tubular member 2, cracks 7 can possibly occur at its burn through portions 6, as shown in FIG. 5.

SUMMARY OF THE INVENTION

The invention has been devised to overcome the above-described problems, and its object is to provide a method of fabricating a catalyst converter which makes it possible to prevent the burn through in the plate member during the formation of the tubular member.

To achieve the above object, according to the present invention, there is provided a method of fabricating a catalyst converter comprising the steps of: obtaining a tubular member by rolling up a metallic plate member of a rectangular shape having ear portions at four corners thereof such that opposing ones of the ear portions abut against each other, and by effecting butt welding for both ends of the plate member; cutting off projecting portions formed by the ear portions at both ends of a weld of the tubular member; incorporating a catalyst carrier into the tubular member with the projecting portions cut off; effecting drawing for both end portions of the tubular member with the catalyst carrier incorporated therein; and attaching a pair of flanges, respectively, to the both end portions of the tubular member subjected to drawing.

Also, according to the present invention, in the method of fabricating a catalyst converter, each of the projecting portions formed by the ear portions may have a substantially trapezoidal shape, and an amount of projection thereof is longer than a burn through portion formed in butt welding.

DETAILED DESCRIPTION OF THE PREFERRED EMBODIMENTS

Referring now to the accompanying drawings, a description will be given of an embodiment of the invention.

FIGS. 1A to 1F illustrate a method of fabricating a catalyst converter in accordance with an embodiment of the invention.

Figure 1A:
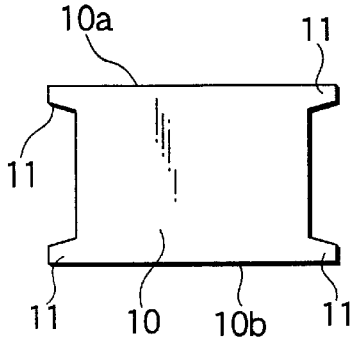
FIGS. 1A to 1F are explanatory diagrams illustrating a method of fabricating a catalyst converter in accordance with an embodiment of the invention.

First, as shown in FIG. 1A, a metallic plate member 10 of a rectangular shape in which ear portions 11 are provided at its four corners is prepared.

These ear portions 11 are formed by trapezoidal projecting portions respectively extending flush outwardly from both ends 10*a* and 10*b* on abutting sides of the plate member 10.

Figure 2:
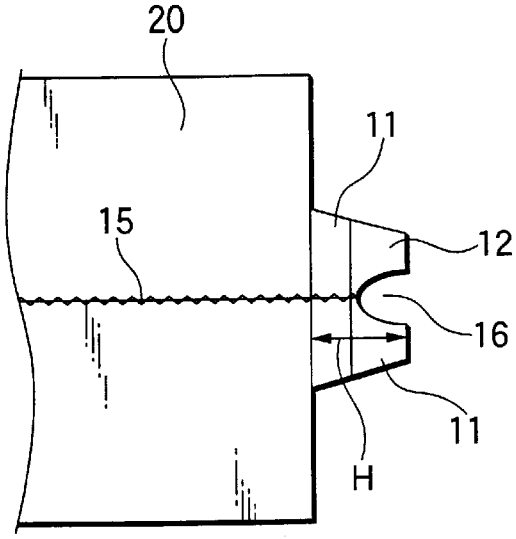
FIG. 2 is an explanatory diagram illustrating a detailed portion of a weld.
Figure 3:
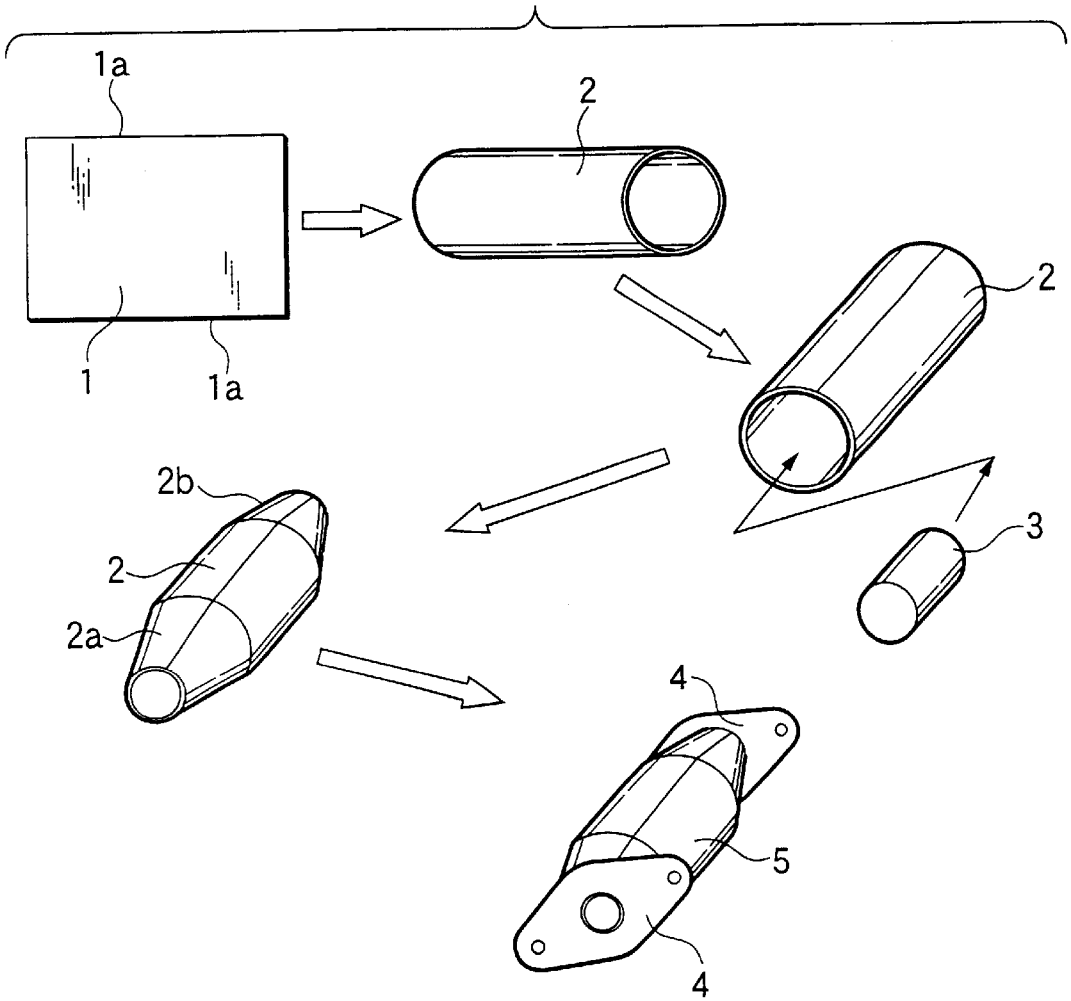
FIG. 3 is an explanatory diagram illustrating a conventional method of fabricating a catalyst converter.
Figure 4:
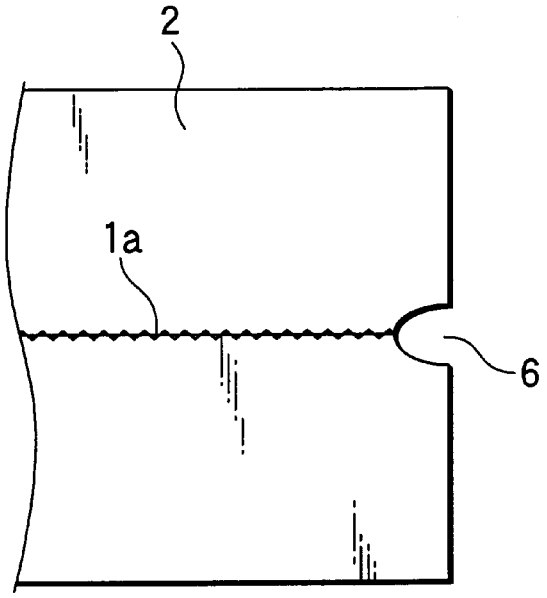
FIG. 4 is an explanatory diagram illustrating a state in which burn through has occurred in a plate member shown in FIG. 3 at a starting point and a terminating point of welding.
Figure 5:
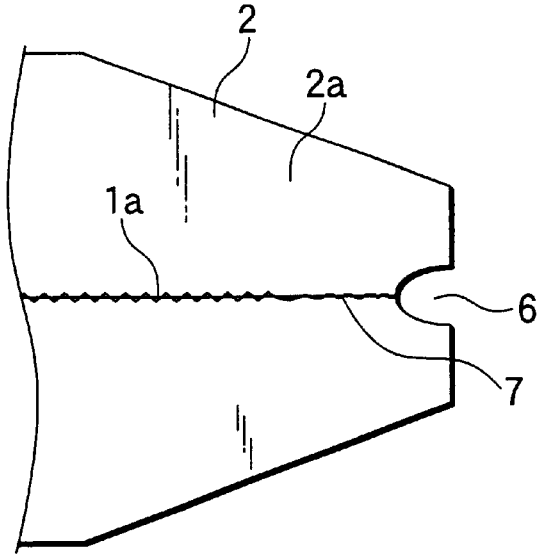
FIG. 5 is an explanatory diagram illustrating a state in which a crack occurs at a burn through portion when both end portions of a tubular member obtained in FIG. 3 are subjected to drawing based on spinning.

As shown in FIG. 2, an amount of projection, H, of each of these ear portions 11 is set to be longer than a burn through portion 16 formed in butt welding.

Figure 1B:
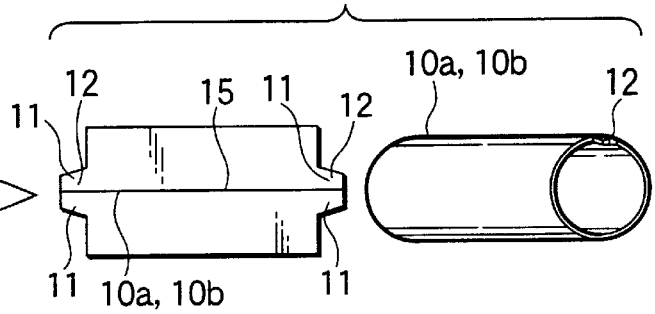

Next, as shown in FIG. 1B, in accordance with a conventional process the plate member 10 is rolled up, its both ends 10*a* and 10*b* are caused to abut against each other, and the abutting both ends 10*a* and 10*b* and the ear portions 11 continuing therefrom are subjected to welding such as TIG or MIG.

As shown in FIG. 2, burn through occurs in this weld 15 at a starting point 15A and a terminating point 15B of welding. However, its burn through portion 16 does not extend over an entire region of each of two projecting portions 12 formed by the ear portions 11. This is because the amount of projection, H, of each of the ear portions 11 (i.e., the amount of projection of each of the projecting portions 12) is set to be longer than the burn through portion 16 formed in butt welding, as described above. Since this amount of projection, H, varies depending on various plate members, the amount of projection, H, is determined by conducting a test or a simulation, as required, in accordance with its application of use.

Figure 1C:
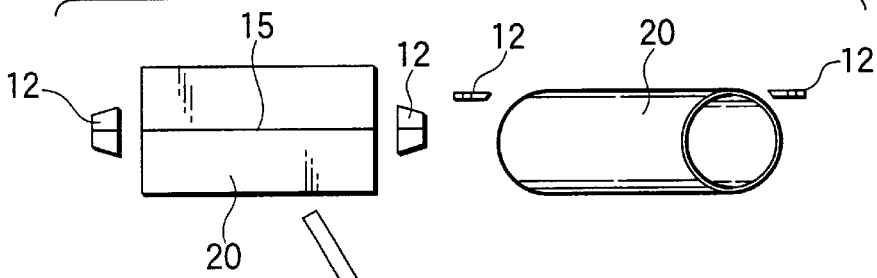

Next, as shown in FIG. 1C, the two projecting portions 12 formed by the respective ear portions 11 are cut off.

Figure 1D:
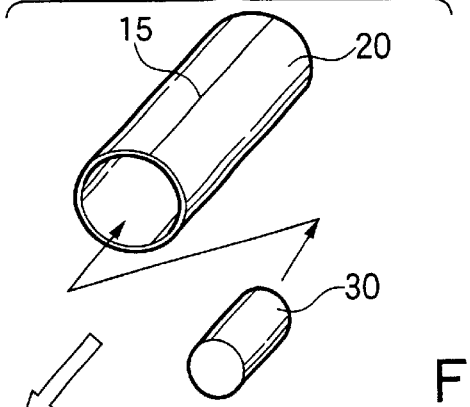

Next, as shown in FIG. 1D, a known catalyst carrier 30 is press fitted into a tubular member 20 thus obtained.

Figure 1E:
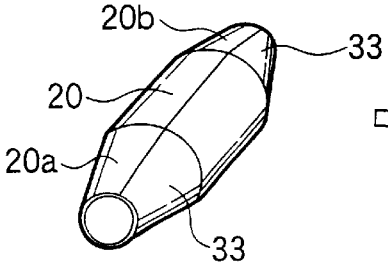

Next, as shown in FIG. 1E, both end portions 20*a* and 20*b* of the tubular member 20 are subjected to drawing based on spinning. Here, both end portions 20*a* and 20*b* are spaced apart a predetermined distance from both ends of the catalyst carrier 30 press fitted in the tubular member 20, and a pair of diffusers 33 are formed by drawing.

Figure 1F:
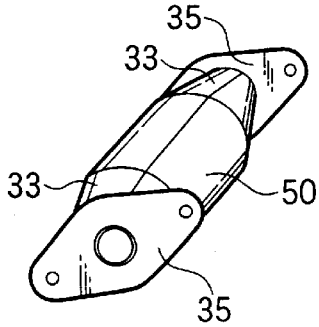

Next, as shown in FIG. 1F, a pair of flanges 35 are respectively attached to the diffusers 33 by welding. Thus, a catalyst converter 50 can be obtained.

As described above, in accordance with this embodiment, since the ear portions 11 are provided which are formed by the trapezoidal projecting portions respectively extending flush outwardly from both ends 10*a* and 10*b* on the abutting sides of the plate member 10, when the plate member 10 is rolled up and butt welding is effected, the burn through portions 16 are formed in the projecting portions 12 formed by the ear portions 11 on both sides. Hence, the burn through does not occur in the portion which forms the tubular member 20.

Accordingly, the tubular member 20 which is free of the burn through portions 16 can be obtained by cutting off the projecting portions 12 after welding.

Consequently, there is no possibility of the occurrence of the trouble that a crack occurs from the weld 15 at the time of drawing based on spinning of both end portions 20*a* and 20*b* of the tubular member 20 which is effected after the press fitting of the catalyst carrier 30 into the tubular member 20.

Spinning is facilitated by the above-described arrangement.

As described above, in accordance with the invention, since it is possible to reliably eliminate burn through portions of the weld at the time of the welding of the tubular member, a crack does not occur at the weld during spinning.

What is claimed is:

1. A method of fabricating a catalyst converter, characterized by comprising the steps of:

obtaining a tubular member by rolling up a metallic plate member of a rectangular shape having ear portions at four corners thereof such that opposing ones of said ear portions abut against each other, and by effecting butt welding for both ends of said plate member;

cutting off projecting portions formed by said ear portions at both ends of a weld of said tubular member;

incorporating a catalyst carrier into said tubular member with said projecting portions cut off;

effecting drawing for both end portions of said tubular member with said catalyst carrier incorporated therein; and attaching a pair of flanges, respectively, to said both end portions of said tubular member subjected to drawing.

2. The method according to claim 1, wherein each of said projecting portions formed by said ear portions has a substantially trapezoidal shape.

3. The method according to claim 2, wherein the amount of projection of said ear portions is longer than a burn through portion formed in butt welding.

* * * * *